US012318674B1

(12) United States Patent
Liu

(10) Patent No.: US 12,318,674 B1
(45) Date of Patent: Jun. 3, 2025

(54) FOLDABLE LADDER TOSS GAME APPARATUS

(71) Applicant: Shasha Liu, Zhejiang (CN)

(72) Inventor: Shasha Liu, Zhejiang (CN)

( * ) Notice: Subject to any disclaimer, the term of this patent is extended or adjusted under 35 U.S.C. 154(b) by 0 days.

(21) Appl. No.: 18/942,727

(22) Filed: Nov. 10, 2024

(51) Int. Cl.
*A63B 67/06* (2006.01)

(52) U.S. Cl.
CPC ..... *A63B 67/06* (2013.01); *A63B 2210/58* (2013.01)

(58) Field of Classification Search
CPC .. A63B 67/06; A63B 2210/50; A63B 2210/58
See application file for complete search history.

(56) References Cited

U.S. PATENT DOCUMENTS 4,491,327 A * 1/1985 Morris ..... A63B 67/06 D21/441
4,648,481 A * 3/1987 Lee ..... E06C 1/32 182/35
5,906,552 A * 5/1999 Padilla ..... A63B 69/0097 473/421
7,198,273 B1 * 4/2007 Advocate ..... A63B 43/007 273/343
D570,417 S * 6/2008 Poe ..... D21/302
7,703,771 B2 * 4/2010 Hunt ..... A63B 67/002 273/343
9,675,829 B1 * 6/2017 Katz ..... A63B 17/02
10,406,419 B1 * 9/2019 Dickerson ..... A63B 69/0091
2006/0125184 A1 * 6/2006 Benson ..... A63B 67/002 273/343
2007/0035093 A1 * 2/2007 Fuchs ..... A63B 67/06 273/343
2011/0291361 A1 * 12/2011 Moeller ..... A63B 63/00 273/348
2013/0040762 A1 * 2/2013 Swingle ..... A63B 63/08 473/422
2016/0023095 A1 * 1/2016 Nally ..... A63F 7/3055 273/343
2019/0070472 A1 * 3/2019 Duran ..... A47F 5/04
2020/0197776 A1 * 6/2020 Gonzalez ..... A63B 69/0013
2020/0306603 A1 * 10/2020 Burns ..... A63B 67/06
2022/0080272 A1 * 3/2022 Nappe ..... F16M 11/26
2022/0105403 A1 * 4/2022 Berkowitz ..... A63B 61/02

* cited by examiner

*Primary Examiner* — Raleigh W Chiu
(74) *Attorney, Agent, or Firm* — Hawaii Patent Services; Nathaniel K. Fedde; Kenton N. Fedde

(57) ABSTRACT

A foldable ladder toss game apparatus comprises at least two frames, and each frame comprises a telescopic rod and a folding base; wherein, a rung assembly is arranged between two adjacent frames, and the rung assembly is able to stretch and retract to adjust a distance between the two adjacent frames; wherein, the folding base comprises a connector connected to the telescopic rod, and at least two support legs.

16 Claims, 5 Drawing Sheets

FOLDABLE LADDER TOSS GAME APPARATUS

BACKGROUND OF THE INVENTION

1. Technical Field

The invention relates to the technical field of ladder ball games, in particular to a foldable ladder toss game apparatus.

2. Description of Related Art

Ladder toss games, also called ladder golf games, are popular entertainment in the park and at the beach.

Most ladder frames in the form of a ladder of existing ladder toss games are assembled fixedly and cannot be folded or unfolded, thus having a large packing size and being inconvenient to transport and store.

For example, existing US Invention Patent No. 20050082761 discloses a target game with rungs, and existing US Invention Patent No. 20090278317 discloses a golf toss game. Ladder frames in the two patents cannot be folded or unfolded and have a large size when packed and stored, thus being inconvenient to transport and store.

In view of this, it is necessary to provide a novel foldable ladder toss game apparatus that is easy to transport and store.

BRIEF SUMMARY OF THE INVENTION

The objective of the invention is to provide a foldable ladder toss game apparatus to solve the problem that existing ladder ball game apparatuses are inconvenient to transport and store as mentioned above.

To fulfill the above objective, the invention provides a foldable ladder toss game apparatus, comprising frames, wherein the number of the frames is at least two, and each frame comprises a telescopic rod and a folding base; wherein, a rung assembly is arranged between two adjacent frames, and the rung assembly is able to stretch and retract to adjust a distance between the two adjacent frames; wherein, the folding base comprises a connector connected to the telescopic rod, and at least two support legs; the support legs are rotatably connected to the connector and have a support state and a folded state; when the support legs are in the support state, an included angle is formed between two support legs facing each other; and a limit assembly is arranged at a joint between the connector and each support leg and used for realizing rotation of the support leg and maintaining the support leg in the support state.

The invention further provides a foldable ladder toss game apparatus, comprising frames, wherein the number of the frames is at least two, and each frame comprises a vertical telescopic part and a folding base; wherein, a horizontal telescopic part is arranged between two adjacent frames; wherein, the folding base comprises a connector connected to the vertical telescopic part, and at least two support legs; the support legs are rotatably connected to the connector and have a support state and a folded state; a limit assembly is arranged at a joint between the connector and each support leg and used for realizing rotation of the support leg and maintaining the support leg in the support state; wherein, a tensioning mechanism is arranged in each support leg and used for maintaining the support leg in the support state or in the folded state.

The invention further provides a foldable ladder toss game apparatus, comprising frames, wherein the number of the frames is at least two, and each frame comprises a vertical telescopic part and a folding base; wherein, a horizontal telescopic part is arranged between two adjacent frames; wherein, the folding base comprises a connector connected to the vertical telescopic part, and at least two support legs; the support legs are rotatably connected to the connector and have a support state and a folded state; a limit assembly is arranged at a joint between the connector and each support leg and used for realizing rotation of the support leg and maintaining the support leg in the support state; wherein, each support leg has a rotary end and a free end, a clamping structure used together with the limit assembly is arranged at the rotary end of the support leg, and the clamping structure is used for maintaining the support leg in the support state.

Figure 1:
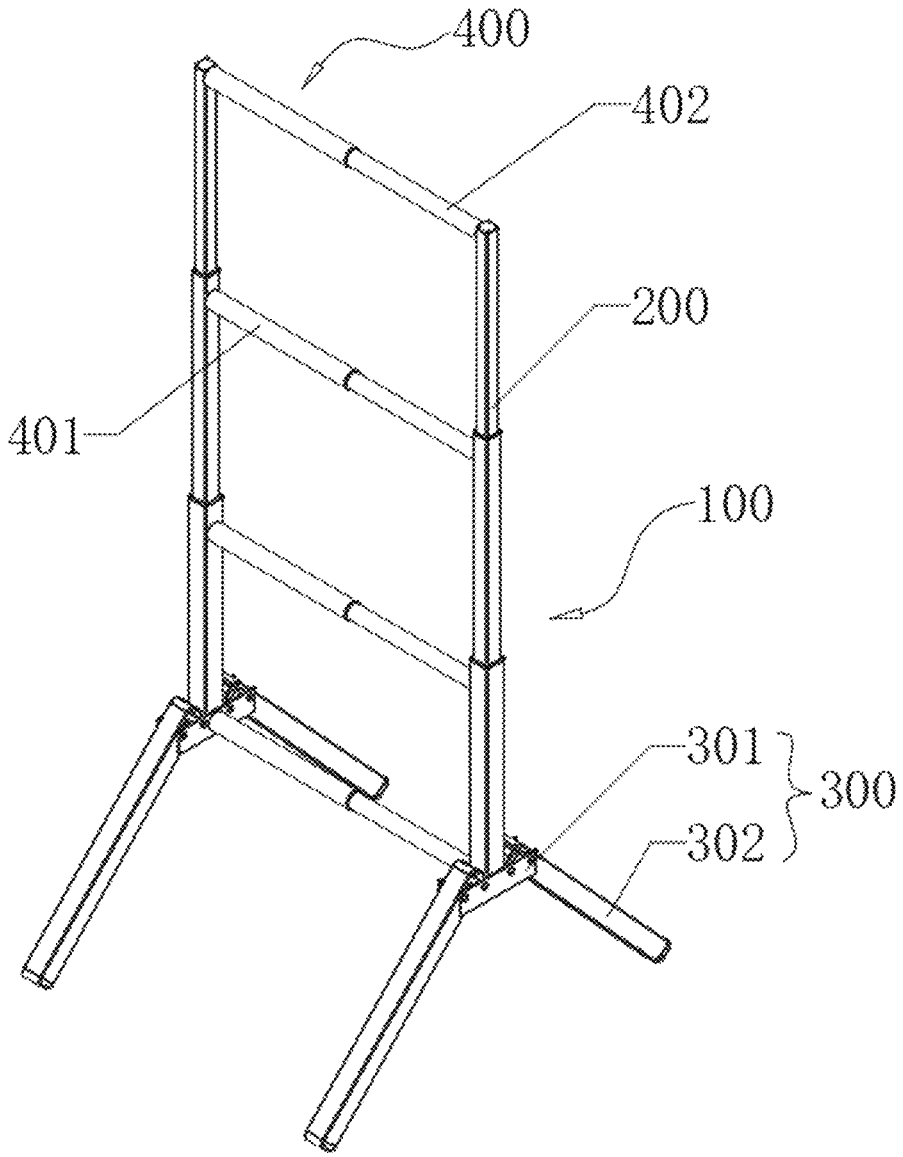
FIG. 1 is an overall perspective structural view according to the invention.

In the FIGS.: (100), frame; (200), telescopic rod; (300), folding base; (301), connector; (3011), support shaft; (3012), limit shaft; (3013), mounting groove; (302), support leg; (3021), link; (3022), elastic element; (3023), first through-groove; (303), end cover; (3031), second through-groove; (3032), recess; (400), rung assembly; (401), sleeve tube; (402), movable bar.

DETAILED DESCRIPTION OF THE INVENTION

Referring to FIGS. 1-5:

The invention provides a foldable ladder toss game apparatus, comprising frames 100, wherein the number of the frames 100 is at least two, and each frame 100 comprises a telescopic rod 200 and a folding base 300; wherein at least one rung assembly 400 is arranged between two adjacent frames 100, and the rung assembly 400 is able to stretch and retract to adjust a distance between the two adjacent frames 100; wherein, the folding base 300 comprises a connector 301 connected to the telescopic rod 200, and at least two support legs 302; the support legs 302 are rotatably connected to the connector 301 and have a support state and a folded state; when the support legs 302 are in the support state, an included angle is formed between two support legs 302 facing each other; limit assemblies are arranged at joints between the connector 301 and the support legs 302 and used for realizing rotation of the support legs 302 and maintaining the support legs 302 in the support state.

In this embodiment, as shown in FIG. 1, the foldable ladder toss game apparatus comprises two frames 100, and two support legs 302 are arranged at the bottom of each of the two frames 100. The telescopic rods 200 adopt a tube-in-tube form in the prior art and are able to stretch and retract vertically to adjust the overall height of a ladder to satisfy the requirements of different users. The rung assembly 400 is able to stretch and retract to adjust the distance between the two adjacent frames 100 so as to satisfy the requirements of different users. The support legs 302 can be turned on the connector 301; when turned upwards, the support legs 302 come in close fit with the telescopic rod 200 to be folded; on the contrary, when the support legs 302 are turned downwards, an included angle less than 180° will be formed between the two support legs 302 facing each other, and the two support legs 302 work together to support the frame 100 on the same side, such that the whole ladder can be supported and erected to be used.

Preferably, the included angle between the two support legs 302 ranges from 900 to 180°, such that a stable triangular support structure can be formed to improve the stability of the ladder.

Figure 5:
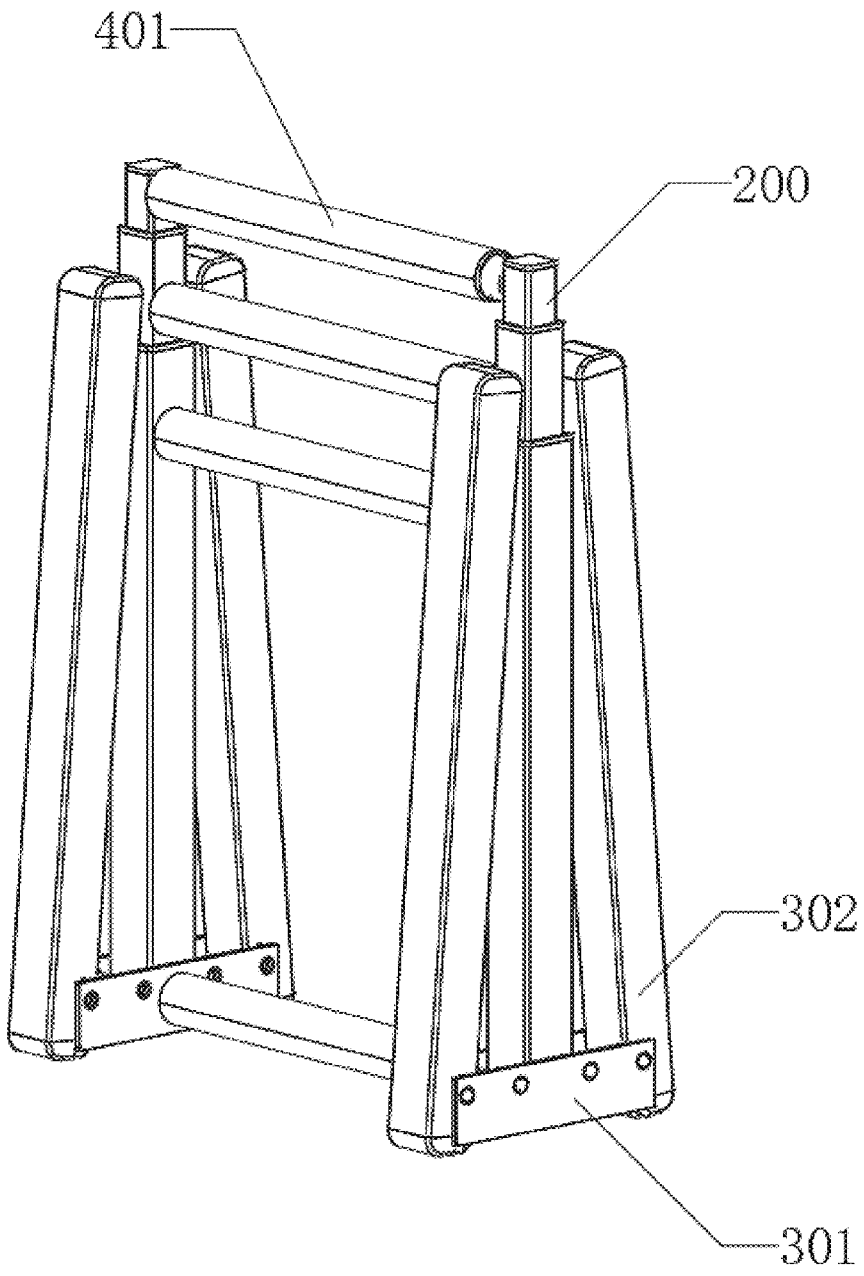
FIG. 5 is a state diagram of a foldable ladder toss game apparatus in a folded state according to the invention.

According to the above description, by means of the telescopic rods 200 and the rung assembly 400 that can stretch and retract and the support legs 302 that can be turned to be folded, the length, width and height of the ladder can be reduced when the ladder is transported or stored, as shown in FIG. 5, so as to reduce the packing size, thus facilitating transport and storage, reducing transport and storage costs, and increasing economic benefits of products.

In this embodiment, as shown in FIG. 1, the rung assembly 400 comprises a sleeve tube 401 and a movable bar 402, wherein the movable bar 402 is inserted into the sleeve tube 401 and slidably connected to the sleeve tube 401, the sleeve tube 401 is arranged on a side face of one telescopic rod, and the movable bar 402 is arranged on a side face of the other adjacent telescopic rod 200. The movable bar 402 can slide in an axial direction of the sleeve tube 401 to adjust the length of the rung assembly 400 so as to adjust the distance between the two frames 100.

In a possible embodiment, as shown in FIG. 1, a rung assembly 400 may be mounted between the two connectors 301 to improve the stability of the folding bases 300.

In other embodiments (not shown) of the rung assembly 400, the rung assembly 400 may be formed by multiple short bars, and the short bars are detachably connected, for example, by means of bolts or fasteners. In this way, when the ladder is used, multiple short bars can be assembled between the two frames, and the distance between the two frames can be adjusted by changing the number of short bars assembled between the two frames. Of course, when the ladder is transported or stored, the short bars can be detached from the frames to reduce the packing size.

In other embodiments (not shown) of the rung assembly 400, the rung assembly 400 may be formed by multiple short bars that are hinged to each other, and every two adjacent short bars can rotate relatively. When all the short bars are rotated to be in a horizontal state, a horizontal rung is formed and arranged between the two frames 100. In this way, when the ladder is transported or stored, the rung assembly 400 can be folded to reduce the packing size.

In other embodiments (not shown) of the telescopic rod 200, the telescopic rod 200 may also be formed by multiple short bards that are hinged to each other. In use, the short bars can be rotated to be in a vertical state to form a vertical telescopic rod 200. In this way, when the ladder is transported or stored, the telescopic rod 200 can be folded to reduce the packing size.

Figure 2:
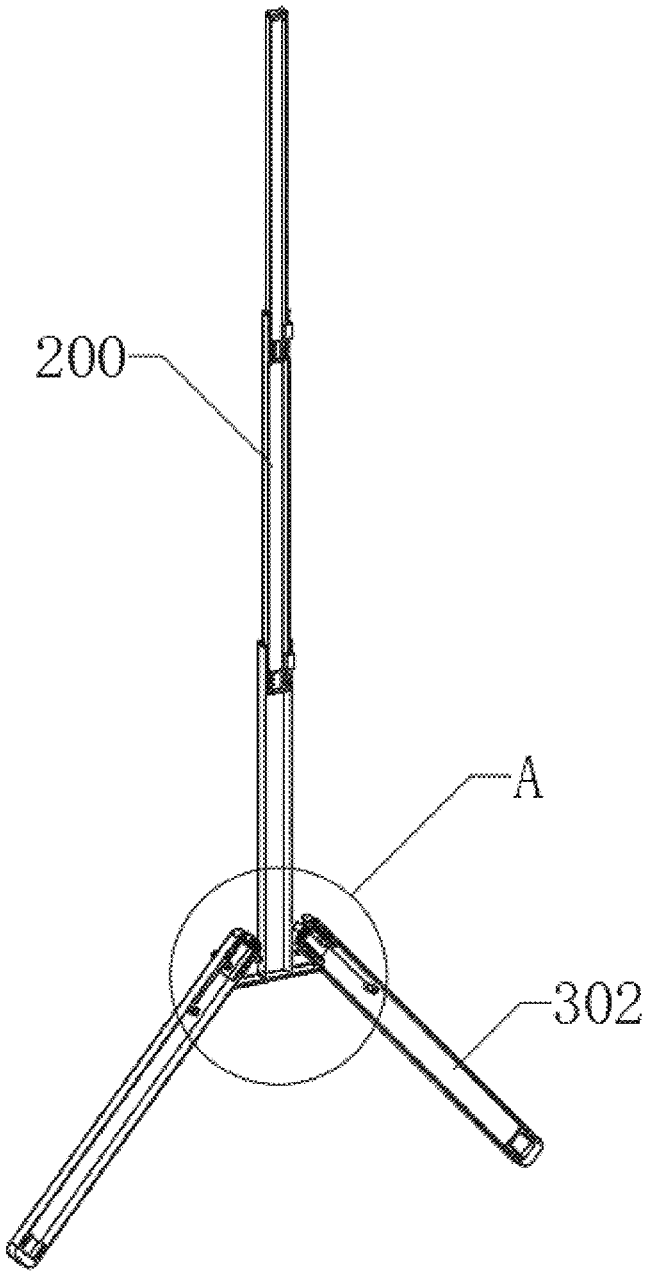
FIG. 2 is a sectional view of a frame according to the invention.
Figure 3:
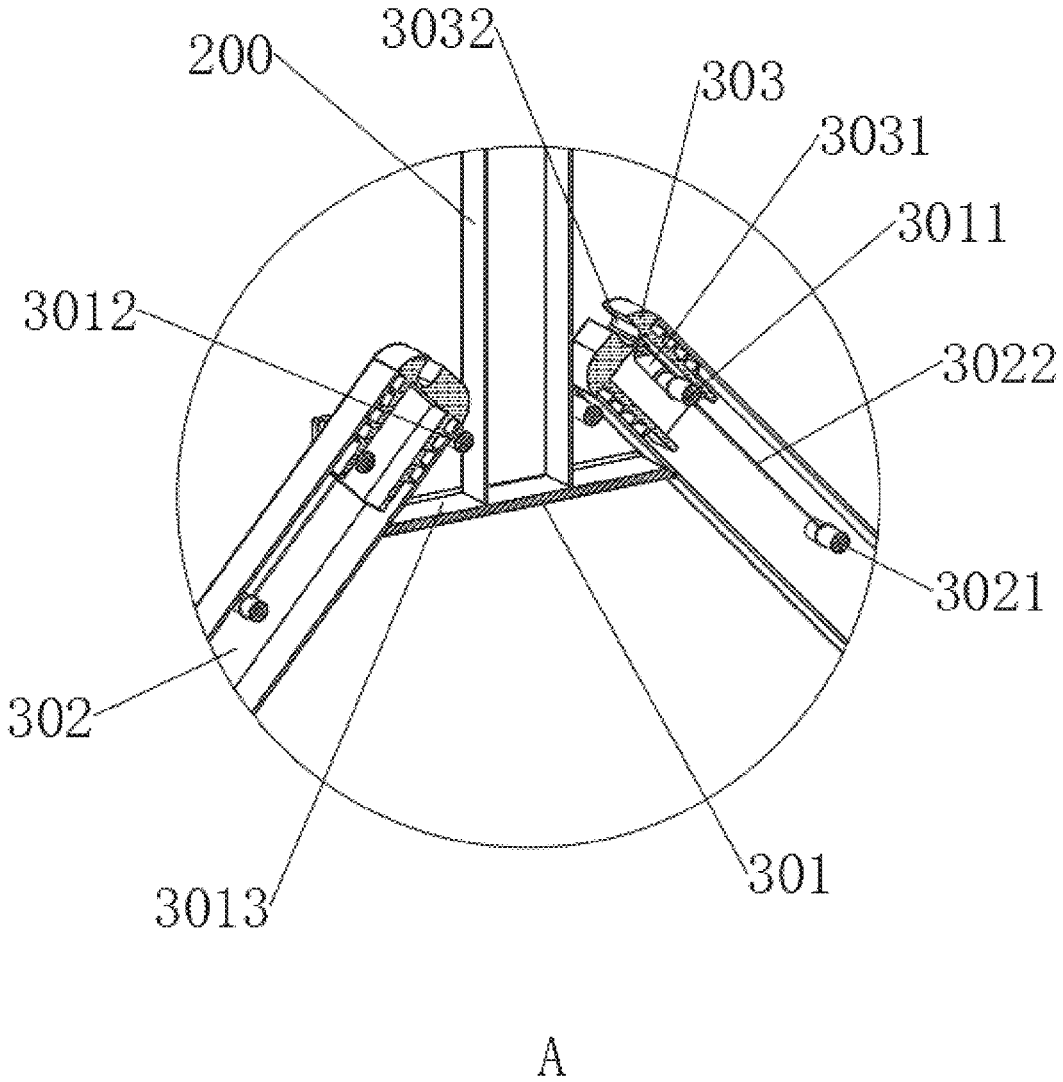
FIG. 3 is an enlarged view of part A in FIG. 2 according to the invention.
Figure 4:
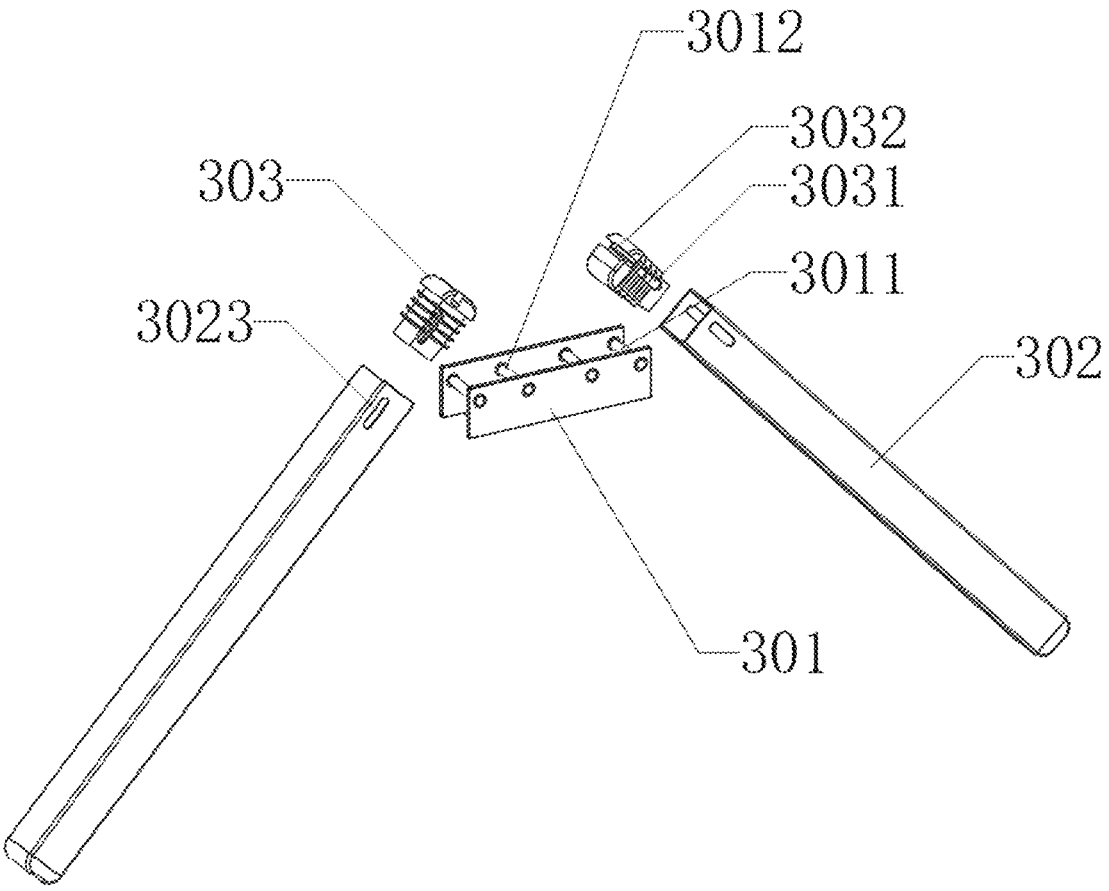
FIG. 4 is an exploded view of a folding base according to the invention.

As shown in FIG. 2-3, the connector 301 is concaved to form a mounting groove 3013, and the bottom of the telescopic rod 200 is mounted at the bottom of the mounting groove 3013. Each support leg 302 has a rotary end and a free end, and the rotary ends of the at least two support legs 302 are arranged in the mounting groove 3013 and respectively located on two sides of the telescopic rod 200. Wherein, in the folded state, the support legs 302 are in close fit with the telescopic rod 200. Each limit assembly comprises a support shaft 3011 and a limit shaft 3012, wherein the support shaft 3011 and the limit shaft 3012 are both inserted into the mounting groove 3013; wherein, a first through-groove 3023 is formed in the rotary end of each support leg 302, and the support shaft 3011 penetrates through the first through-groove 3023. The first through-groove 3023 has a space allowing the support shaft 3011 to slide therein, and has a rotating position and a support position. When the support shaft 3011 is located at the support position, the limit shaft 3012 is located within a radius of rotation of the rotary end; when the support shaft 3011 is located at the rotating position, the limit shaft 3012 is located beyond the radius of rotation of the rotary end. The support legs 302 are hollow, and links 3021 are arranged in the support legs 302 and are close to the free ends of the support legs 302; and elastic elements 3022 are mounted between the links 3021 and the support shafts 3011.

In this embodiment, the first through-grooves 3023 are strip-shaped, and the support shafts 3011 can move in the first through-grooves 3023, for example, the support shafts 3011 can slide or rotate in the first through-grooves 3023. The free ends of the support legs 302 are erected on the ground, and the rotary ends of the support legs 302 are matched with the support shafts 3011 by means of the first through-grooves 3023 and can rotate in the mounting groove 3013 of the connector 301, such that the support legs 301 have the folded state and the support state. Of course, the first through-grooves 2023 are not limited to the strip shape, and may also be T-shaped, Y-shaped or in other geometrical shapes that can realize a limiting effect (not shown).

According to the above description, as shown in FIG. 3, when the support legs 302 are in the support state, the support shafts 3011 slide to ends, away from the telescopic rod 200, of the first through-grooves 3023 (the support positions), at this moment, the limit shafts 3012 are located within the radius of rotation of the rotary ends, and the rotary ends abut against the tops of the limit shafts 3012. In this way, when the free ends of the support legs 302 abut against the ground, the limit shafts 3012 can limit the rotary ends to prevent further rotation of the rotary ends, thus ensuring the support stability of the support legs 302.

When the support legs 302 are in a rotatable state (not shown), the support shafts 3011 slide to ends, close to the telescopic rod 200, of the first through-grooves 3023 (the rotating positions), and at this moment, the limit shafts 3012 are located beyond the radius of rotation of the rotary ends, such that the rotary ends can rotate freely in the mounting groove 3013 to fold the support legs 302 or push the support legs 302 to rotate.

In other embodiments (not shown) of the limit assembly, the limit assembly may realize a limiting effect by snap fit between elastic protrusions and recesses. For example, recesses corresponding to the folded state and the support state are formed in the mounting groove 3013, and the elastic protrusions are mounted on the support legs 302. When the support legs 302 are in the support state, the elastic protrusions are clamped in the recesses corresponding to the support state; and when the support legs 302 are in the folded state, the elastic protrusions are clamped in the recesses corresponding to the folded state. In this way, the support legs 302 are stable enough both in the folded position and in the support position.

Of course, if the support legs 302 have a horizontal state, recesses may be formed in positions where the support legs 302 are placed horizontally. In this way, the support legs 302 can be maintained at the horizontal positions more stably in the horizontal state and will not come loose.

As shown in FIG. 3, to further improve the stability of the support legs 302 in the support state, tensioning mechanisms are arranged in the support legs 302 and used for maintaining the support legs 302 in the support state or in the folded state. Wherein, each tensioning mechanism comprises a connecting rod and an elastic element 3022, the connecting rods are mounted in the support legs 302 and are close to the free ends of the support legs 302, and the elastic elements 3022 are mounted between the connecting rods and the support shafts 3011.

In this embodiment, the elastic elements 3022 are elastic bands, springs or other elastic components, and have a retractive elastic force. In this way, when the support legs 302 are in the support state, the support shafts 3011 can be pulled to abut against the support positions more tightly under the action of the elastic force of the elastic elements 3022, such that the rotary ends are kept in contact with the limit shafts 3012 and prevented from rotating. In this way, the stability of the support legs 302 in the support state is improved.

Of course, the tensioning mechanisms not only can improve the stability of the support legs 302 in the support state, but also can improve the stability of the support legs 302 in the folded state. As shown in FIG. 5, when the support legs 302 are folded upwards and come close to the telescopic rod 200, the tops of the rotary ends will stretch out of the mounting groove 3013 and be limited by bottom edges of the mounting groove (referring to FIG. 3, the mounting groove 3013 has two edges in close fit with the support legs 302 respectively), under the action of the elastic force of the elastic elements 3022, the support shafts 3011 can be pulled to abut against the support positions more tightly, and at this moment, the elastic elements 3022 work together with the edges of the mounting groove 3013 to ensure that the support legs 302 are more stable and unlikely to shake in the folded state.

As shown in FIGS. 2-3, in this embodiment, the support legs 302 also have a horizontal state. Wherein, an end cover 303 is inlaid in the rotary end of each support leg 302 and provided with a clamping structure used together with the corresponding limit assembly.

Specifically, a second through-groove 3031 corresponding to the first through-groove 3023 is formed in the end cover 303, and the support shaft 3011 penetrates through the second through-groove 3031. The clamping structure comprises a recess 3032 formed in an outer surface of the end cover 303; wherein, when the support legs 302 are in the horizontal state, the limit shafts 3012 are inlaid in the recesses 3032.

When the support legs 302 rotate to be in the horizontal state, the recesses 3032 in the end covers 303 will be exactly flush with the limit shafts 3012, and then under the action of the elastic force of the elastic elements 3022, the support legs 302 are pushed to slide towards the limit shafts 3012, and the limit shafts 3012 are clamped in the recesses 3032 to limit the support legs 302, such that the support legs 302 are prevented from rotating.

When all the support legs 302 are in the horizontal state, the contact area between the support legs 302 and the ground will be larger, such that the ladder can be placed more stably and is unlikely to fall.

In other embodiments (not shown) of the clamping structure, the recess 3032 may be directly formed in a side, facing the limit shaft 3012, of the rotary end, such that when the support leg 302 is in an oblique support state, the limit shaft 3012 can be clamped in the recess 3032. In this way, the contact stability between the support legs 302 and the limit shafts 3012 can be improved, and the support legs 302 are further prevented from coming loose and maintained in the support state.

What is claimed is:

1. A foldable ladder toss game apparatus comprising at least two frames, wherein each of said at least two frames comprises a telescopic rod and a folding base;

wherein, a rung assembly is arranged between two adjacent frames of said at least two frames, and the rung assembly is able to stretch and retract to adjust a distance between the two adjacent frames;

wherein, the folding base of each of said at least two frames comprises a) a connector connected to the telescopic rod and concaved to form a mounting groove, wherein a bottom of the telescopic rod is mounted at a bottom of the mounting groove and b) at least two support legs facing each other which are rotatably connected to the connector and configured to be positioned in i) a folded state and ii) a support state in which an included angle is formed between the at least two support legs;

wherein, for each of the at least two support legs of each of the folding bases, a respective limit assembly is arranged at a joint between the connector of the respective folding base and the respective support leg and configured to be used for realizing rotation of the respective support leg and maintaining the respective support leg in the support state; and wherein, each of the limit assemblies comprises a support shaft and a limit shaft configured to be used together to maintain the respective support leg in an oblique support state.

2. The foldable ladder toss game apparatus according to claim 1, wherein each of the rung assemblies comprises a) a sleeve tube and b) a movable bar inserted into the sleeve tube and slidably connected to the sleeve tube.

3. The foldable ladder toss game apparatus according to claim 2, wherein the sleeve tube is arranged on a side face of said telescopic rod of one frame of the at least two frames, and the movable bar is arranged on a side face of said telescopic rod of an adjacent frame of the at least two frames.

4. The foldable ladder toss game apparatus according to claim 1, wherein each said support leg has a rotary end and a free end, and the rotary ends of the at least two support legs are arranged in the mounting groove of the connector and located on two sides of the telescopic rods of the at least two frames respectively; and wherein, in the folded state, each of the support legs are in close fit with the respective telescopic rod.

5. The foldable ladder toss game apparatus according to claim 4, wherein each support shaft and each limit shaft are inserted into the respective mounting groove; and wherein, a first through-groove is formed in the rotary end of each support leg, and the respective support shaft penetrates through the first through-groove.

6. The foldable ladder toss game apparatus according to claim 5, wherein each respective first through-groove has a space allowing the respective support shaft to slide therein, and has a rotating position and a support position.

7. The foldable ladder toss game apparatus according to claim 6, wherein when each support shaft is located at the support position, the respective limit shaft is located within a radius of rotation of the respective rotary end; and when each support shaft is located at the rotating position, the respective limit shaft is located beyond the radius of rotation of the rotary end.

8. The foldable ladder toss game apparatus according to claim 5, wherein each of the support legs is hollow, and a respective link is arranged in each of the support legs and is close to the free end of the respective support leg; and respective elastic element is mounted between each of the links and the respective support shaft.

9. A foldable ladder toss game apparatus comprising at least two frames, wherein each frame of said at least two frames comprises a vertical telescopic part and a folding base;

wherein, a horizontal telescopic part is arranged between two adjacent frames of said at least two frames; and wherein, the folding base of each of said at least two frames comprises a) a connector—connected to the vertical telescopic part and concaved to form a mounting groove, wherein a bottom of the vertical telescopic part is mounted at a bottom of the mounting groove, and b) at least two support legs which are rotatably connected to the connector and configured to be positioned in i) folded state and ii) a support state;

wherein, for each of the at least two support legs of each of the folding bases, a respective limit assembly is arranged at a joint between the connector of the respective folding base and the respective support leg and configured to be used for realizing rotation of the respective support leg and maintaining the respective support leg in the support state; and wherein, a respective tensioning mechanism is arranged in each said of said support legs and used for maintaining the respective support leg in the support state or in the folded state.

10. The foldable ladder toss game apparatus according to claim 9, wherein each of the vertical telescopic parts is a respective telescopic rod, each of the horizontal telescopic parts is a rung assembly, and each of the rung assemblies is able to stretch and retract to adjust a distance between the two adjacent frames.

11. The foldable ladder toss game apparatus according to claim 9, wherein each said respective support leg has a rotary end and a free end, and each of the rotary ends of the at least two support legs is arranged in the respective mounting groove and located on two sides of the respective vertical telescopic part.

12. The foldable ladder toss game apparatus according to claim 11, wherein each of the limit assemblies comprises a respective support shaft and a respective limit shaft, and each of the support shafts and each of the limit shafts are inserted into the respective mounting groove; and wherein, a first through-groove is formed in the rotary end of the respective support leg, the respective support shaft penetrates through the first through-groove, and the first through-groove has a space allowing the respective support shaft to slide therein.

13. The foldable ladder toss game apparatus according to claim 12, wherein each respective tensioning mechanism comprises a connecting rod and an elastic element, each respective connecting rod is mounted in the respective support leg and is close to the free end of the respective support leg, and each respective elastic element is mounted between the respective connecting rod and the respective support shaft.

14. A foldable ladder toss game apparatus comprising at least two frames, wherein each of said at least two frames comprises a vertical telescopic part and a folding base;

wherein, a horizontal telescopic part is arranged between two adjacent frames of said at least two frames;

wherein, the folding base of each of said at least two frames comprises a) a connector connected to the respective vertical telescopic part and concaved to form a mounting groove, and b) at least two support legs which are rotatably connected to the respective connector and configured to be positioned in i) a folded state and ii) a support state;

wherein, for each of the at least two support legs of each of the respective folding bases, a respective limit assembly is arranged at a joint between the connector of the respective folding base and the respective support leg and configured to be used for realizing rotation of the respective support leg and maintaining the respective support leg in the support state;

wherein each of the respective limit assemblies comprises a support shaft and a limit shaft, and each of the support shafts and each of the limit shafts are inserted into the respective mounting groove of the respective connector of the respective folding base;

wherein, each of the support legs has a respective rotary end and a respective free end, wherein a respective clamping structure assembly is arranged at the rotary end of each of the support legs, and each of the clamping structures is configured to be used together with the limit assembly of the respective support leg for maintaining the respective support leg in the support state; and wherein, a respective first through-groove is formed in the rotary end of each of the support legs, each of the support shafts penetrates through each the first through-groove of the rotary end of the respective support leg, and each of the first through-grooves has a space allowing the respective support shaft to slide therein.

15. The foldable ladder toss game apparatus according to claim 14, wherein a respective end cover is inlaid in the rotary end of the support legs, a respective second through-groove corresponding to the each of the first through-grooves is formed in the respective end cover, and the respective support shaft penetrates through the respective second through-groove.

16. The foldable ladder toss game apparatus according to claim 15, wherein each respective support leg also has a horizontal state, and the respective clamping structure comprises a recess formed in an outer surface of the respective end cover; and wherein, when the respective support leg is in the horizontal state, the respective limit shaft is inlaid in the recess.

* * * * *